United States Patent [19]

van de Plassche et al.

[11] 4,185,236

[45] Jan. 22, 1980

[54] CURRENT STABILIZER

[75] Inventors: Rudy J. van de Plassche; Antonius C. M. Schepens, both of Eindhoven, Netherlands

[73] Assignee: U.S. Philips Corporation, New York, N.Y.

[21] Appl. No.: 872,109

[22] Filed: Jan. 25, 1978

[30] Foreign Application Priority Data

Jan. 27, 1977 [NL] Netherlands ..... 7700807

[51] Int. Cl.[2] ..... G05F 1/56; G05F 1/58

[52] U.S. Cl. ..... 323/1; 323/4; 330/297

[58] Field of Search ..... 307/296 R, 297; 323/1, 323/4; 330/288, 296, 297

[56] References Cited

U.S. PATENT DOCUMENTS

| | | | |
|---|---|---|---|
| Re. 29,700 | 7/1978 | van de Plassache | 323/4 X |
| 3,914,683 | 10/1975 | van de Plassche | 323/1 |
| 3,982,172 | 9/1976 | van de Plassache | 323/4 X |
| 4,001,731 | 1/1977 | Van Sluys | 307/296 R |
| 4,037,118 | 7/1977 | Sieborger et al. | 307/296 R |
| 4,125,803 | 11/1978 | van de Plassche | 323/1 |

*Primary Examiner*—A. D. Pellinen

*Attorney, Agent, or Firm*—Thomas A. Briody; Edward J. Connors, Jr.; James J. Cannon, Jr.

[57] ABSTRACT

A current stabilizing arrangement with a first and a second current circuit in which currents with a fixed ratio relative to each other are sustained. These currents respectively flow through a first semiconductor junction and a second semiconductor junction, a resistor being alternately connected in series with the first and second semiconductor junction. The currents flowing in the first and the second current circuit are interchanged in synchronism therewith.

12 Claims, 12 Drawing Figures

CURRENT STABILIZER

BACKGROUND OF THE INVENTION

1. Field of the Invention

The invention relates to a current stabilizing arrangement comprising a first and a second current circuit and a current mirror circuit for sustaining unequal currents which are in a fixed ratio to each other in said current circuits, a first semiconductor element with a main current path and at least a first and a second electrode, of which at least the first electrode is situated in the main current path, the current in said main current path being a defined function of the voltage between said electrodes, of which first semiconductor element the main current path is included in the forward direction in the first current circuit between the current mirror circuit and a first point, a second semiconductor element which is substantially identical to said first semiconductor element and whose main current path is included in the forward direction in the second current circuit between the current mirror circuit and the first point, both semiconductor elements being formed on one substrate, a third circuit between a second point and the first point via the second and the first electrode of the first semiconductor element, a fourth circuit between a third point and the first point via the second and the first electrode of the second semiconductor element, and means for sustaining equal voltages across the third and the fourth circuit.

Said semiconductor elements may inter alia be diodes, the first and the second electrode depending on the forward direction being constituted by anode and cathode, bipolar transistors, the base electrode being the second electrode and the emitter electrode the first electrode, and fieldeffect transistors, the gate electrode being the second electrode and the source electrode the first electrode.

2. Description of the Prior Art

Current stabilisers of the type mentioned in the preamble are inter alia described in the U.S. Pat. No. 3,914,683. In this current stabilising arrangement equal voltages are maintained across the third and the fourth circuit in that the second and the third point are interconnected. These points are each connected to the base electrode of the first and second transistor which constitute the first and the second semiconductor element respectively, whose main current paths are situated in the first and the second current circuit respectively. One of the two transistors may then be connected as a diode by a collector-base interconnection. The fixed ratio of the currents in the two current circuits can then be maintained by a current mirror coupling between the two current circuits or by using a differential amplifier, to whose inputs voltages are applied which are produced across resistors which are included in the first and the second current circuit, an output of said differential amplifier being connected to the ends of said resistors which are remote from the input of the differential amplifier. In the third circuit a resistor is then included between the first semiconductor element and the first point, through which resistor the smaller of the two currents flows.

In a current stabilising arrangement of the type mentioned in the preamble described in "IEEE Journal of Solid State Circuits", vol. SC-8, no. 3, June 1973, pages 222–226 equal voltages are maintained across the third and fourth circuit in that the second and the third point are respectively connected to the inverting and the non-inverting input of a differential amplifier, whose output is connected to a third point. The third point is connected to the second and third point respectively with resistors which are included in the first and the second current circuit respectively. The two semiconductor elements are then diodes or transistors connected as diodes. The ratio of said resistances defined the ratio of the currents which flow through the first and the second current circuit. The third circuit includes a resistor in series with the first semiconductor element, the smaller of the two currents then flowing through this resistor.

Furthermore, a current stabiliser is known from Netherlands Patent Application No. 7,214,136 which has been laid open for public inspection, in which the first and second semiconductor elements are first and second transistors and in which a resistor is included in the second current circuit in the collector circuit of the second transistor, so that said third circuit is established via said resistor and the base-emitter junction of the first transistor and the fourth circuit via the base-emitter junction of the second transistor. The base of the first transistor is then connected to the collector of the second transistor and the base of the second transistor of the end of said resistor which is remote from the collector of the second transistor.

In current stabilisers of the type mentioned in the preamble additional diodes or transistors connected as diodes may be included in third and fourth circuits, provided that equal numbers of these elements are included in both circuits. Furthermore, identical resistors may be added in the third and the fourth circuit.

The operation of current stabilising arrangements of the type mentioned in the preamble is based on the fact that owing to the fixed ratio between the currents in the two current circuits a stable condition can be obtained only for one specific magnitude (unequal to zero) of these currents. Since equal voltages are maintained across the second and the third circuit these currents should meet the requirement that the difference between the voltages between the two electrodes of the second semiconductor element and between the two electrodes of the third semiconductor element must equal the voltage across the resistor included in the third circuit (or, if additional resistors have been included in the two circuits, equal to the difference between the voltages across the resistors in the two circuits).

For the difference between the voltages across two substantially identical semiconductor junctions, which semiconductor junctions in an integrated circuit have virtually the same temperature and are highly identical except for the geometry, it can be demonstrated that this difference is equal to $(kT/q) \ln (i_{02}/i_{01})$, where k is the Boltzmann constant, T the absolute temperature, q the elementary charge, n the ratio of the two currents through the semiconductor junctions, $i_{01}$ the reverse saturation current of the one semiconductor junction and $i_{02}$ the reverse saturation current of the other semiconductor junction. If the resistor included in the third circuit has a resistance R, the current I through this resistor is then $I=(kT/qR) \ln n (i_{02}/i_{01})$, where $i_{02}$ is substantially equal to $i_{01}$ because the two semiconductors junctions are substantially identical.

From the foregoing it follows that the currents which flow through the first and the second current circuit have a value which is proportional to the temperature. The current at the first point may then also exhibit the same temperature dependence.

In U.S. Pat. No. 3,914,683 it is stated that by the addition of a resistor of suitable resistance in parallel with the second semiconductor junction, a current which is substantially temperature-independent is available at the first point. This is because the current through this resistor is proportional to the voltage across the second semiconductor junction, through which semiconductor junction a current flows which is proportional to the temperature. For the voltage across such a semiconductor junction it can be demonstrated that this voltage has a temperature-independent component and a component with a negative first-order temperature dependence. The current produced in this resistor by this first-order component may then compensate for the positive temperature dependence of the currents which flow in the two current circuits, so that a substantially temperature independent current is obtained. The two patent applications cited supra also give an example of the voltage equivalent of such a temperature-independent current source. For this the generated current with positive temperature dependence is passed through the series connection of the semiconductor junction and a resistor. The voltage component with a positive temperature dependence which is produced across this resistor by said current can then compensate for the component of the voltage across the semiconductor junction having a negative first order dependence. It can be demonstrated that the voltage across said resistor in series with said semiconductor junction is then substantially equal to Egap, which is the gap between the conduction and the valence bands of the semiconductor material used (in the equivalent current source the current then substantially equals $E_{gap}/R$, R being the parallel resistance). In the circuit arrangement in accordance with said article in the "IEEE J.S.S.C" the series connection already forms part of the current stabiliser and the voltage $E_{gap}$ appears between the output of the differential amplifier and the first common point.

When field-effect transistors are employed similar relationships can be obtained, but in that case square-law instead of exponential characteristics are valid.

In the case of bipolar transistors which have been integrated on one substrate using the same process steps, the equality of the said quantities $i_{01}$ and $i_{02}$ is mainly determined by the dimensions of the base-emitter junction. Using conventional technologies errors of 1 to 2% occur relative to the desired current (kT/qR) ln n. For applications in which an accurate current or voltage is desired these errors are too great. The error may be reduced by adjustment of the resistance R, but this is undesirable for production purposes. This is even more so in the said applications where a further resistor is included in order to obtain a temperature-independent voltage or current. Both resistors then influence the temperature coefficent and the value of this voltage or current, so that a uniform adjustment is not possible.

When field-effect transistors are used the errors are mainly determined by deviations of the channel dimensions relative to the desired dimensions.

SUMMARY OF THE INVENTION

It is an object of the invention to provide a current stabilizing arrangement of the type mentioned in the preamble in which the influence of mutual variations in the parameters of said semiconductor junctions on the value of the stabilised currents is appreciably reduced.

For this the invention is characterized in that the current stabilizing arrangement furthermore comprises first switching means for periodically interchanging the currents in said current circuits and second switching means for including a resistor of substantially the same resistance value in either the third or the fourth circuit, whichever includes the two electrodes of the semiconductor element in which the smaller of the two currents flows, so that the same of said two currents flows through said resistor in the third or the fourth circuit.

The invention is based on the recognition that by periodically interchanging the two currents and switching said resistor, the two semiconductor elements are continually interchanged in respect of their function, so that a constant current or voltage is obtained as though the two semiconductor elements were identical, and in addition a ripple current or voltage whose amplitude is determined by the inequality of the two semiconductor elements and which owing to its comparatively low amplitude can simply be filtered out, for example with the aid of an RC element, or even a parasitic capacitance, which can be added inside or outside the circuit. In the described case of bipolar transistors the current I through the resistor R in the one situation will equal (kT/qR) ln n ($i_{01}/i_{02}$) and in the other situation it will equal (kT/qR) ln n ($i_{02}/i_{01}$). The average current will then equal $$\frac{1}{2}\left(\frac{kT}{qR}\ln n\frac{i_{01}}{i_{02}}+\frac{kT}{QR}\ln n\frac{i_{02}}{i_{01}}\right)=\frac{kT}{qR}\ln n.$$

The terms $i_{01}$ and $i_{02}$ which gave rise to errors have disappeared from this expression.

In this respect it is to be noted that including the resistor alternately in the third and the fourth circuit may be effected by switching one and the same resistor or by using two resistors, one in each circuit, one of which is alternately rendered operative.

A very attractive embodiment of a current stabilizer in accordance with the invention is characterized in that the second switching means comprise a first resistor which is included between the first electrodes of the two semiconductor elements and a switch for connecting the first point alternately to the one end and the other end of the first resistor in synchronism with the first switching means.

Owing to this step the second switching means are included outside the second and third circuit and do not affect the voltages across these circuits. Consequently, the resistors and, as the case may be the threshold voltages of the second switching means, do not influence the currents in the two current circuits, so that simple switches may be selected for this purpose, for example transistors to be bottomed.

In a current stabilizing arrangement in which said means for sustaining equal voltages are constituted by a connection of the second point to the third point, which second and third points are constituted by the second electrode of the two semiconductor elements, and in which this connection is driven by the current mirror circuit it is of advantage for similar reasons, that said first switching means are constituted by a cross-over switch which is included between the two semiconductor elements and the current mirror circuit in said current circuits, for periodically interchanging the currents in said current circuits, said drive by-passing this cross-over circuit.

Said cross-over switch is included between the current mirror circuit and the two semiconductor elements, so that neither the voltages across the two circuits, nor the ratio of the currents in the two current circuits are influenced by said first switching means.

In a current stabilizing arrangement in which the second and the third point are constituted by the second electrodes of the first and the second semiconductor element respectively and said current mirror circuit comprises a differential amplifier with an inverting and a non-inverting input and at least one output which is non-inverting relative to said inputs, said first and second current circuits being established, via resistors which connect an output of said differential amplifier alternately to an input, so that said ratio is determined by the ratio of the resistances between the output and the two inputs, in such a way that the resistance between said output and the input which is inverting relative to said output is higher than the resistance between the output and the input which is non-inverting relative to said output is higher than the resistance between the output and the input which is non-inverting relative to said output, it is of advantage in respect of the last-mentioned step, that said resistances between inputs and the output are constituted by a second, third and fourth resistor, of which the second and the fourth resistor are substantially identical and of which the second and the fourth resistor are each connected with one end to one of the two inputs and with the other end each to an other end of the third resistor and said first switching means alternately connecting one of the two ends of the third resistor to an output of the differential amplifier, in such a way that each time the resistance between said output and the input which is inverting relative to said output is higher than the resistance between the said output and the input which is non-inverting relative to said output.

This step enables a smaller number of switches, specifically switching transistors, to be used. For reasons of stability the input which is inverting relative to the output should always be connected to the higher resistance. This may for example be effected by interchanging the two inputs synchronously with the second switching means. However, because differential amplifiers generally have an inverting output it may be of advantage that the differential amplifier has a non-inverting and an inverting output relative to the non-inverting input, one end of the second resistor being connected to the inverting input and one end of the fourth resistor being connected to the non-inverting input and said switching means, via switches, connecting the inverting output to the other end of the second resistor via switches and the non-inverting output to the other end of the fourth resistor, which switches are alternately closed.

Owing to this step said stability requirement is automatically met without the use of additional switches, because an alternating switch for alternately connecting one output to one of the two ends of the third resistor demands the same number of switching transistors as two on/off-switches between the two outputs and the two ends of the third resistor.

It is known to realize a fixed ratio which is unequal to unity by connecting a number of further semiconductor elements in parallel with the semiconductor element which is connected in series with the resistor. In such a current stabilizing arrangement, in which said first and second semiconductor elements are first and second transistors whose control electrodes constitute the second electrodes, which control electrodes are interconnected for sustaining equal voltages across the third and the fourth circuit and are driven by the current mirror circuit, further transistors which are substantially identical to the first and the second transistor and whose control electrodes are connected to the control electrodes of the first and the second transistor being connected in parallel with the transistor whose main current path is included in said current circuit for carrying the smaller current $n-1$, n being greater than one, it is advantageous that the first electrodes of $n+1$ of said transistors lead to a common point, via resistors of substantially equal resistance value, that said second switching means are constituted by an $(n+1)$—step switch for connecting the first point in a cyclically permuting fashion to the first electrode of one of the said $n+1$ transistors, and that the first switching means are constituted by switches, in synchronism with the first switching means interconnecting these ends of the main current paths of all n remaining transistors which are remote from the second electrode in a cyclically permuting fashion, said drive by-passing said first switching means.

In such a circuit arrangement the base-emitter junctions of $n+1$ transistors are included in the third and the fourth circuit in a cyclicly permuting fashion, so that the mutual inequality is averaged out. Moreover, the second switching means again do not form part of the third and the fourth circuit and thus do not influence the voltages across the third and the fourth circuit.

A preferred embodiment of current stabilizing arrangements, in which said first and second semiconductor elements are first and second transistors, whose control electrodes constitute the second electrodes and whose main current paths at the side of the third electrodes which are remote from the first electrodes, are provided with third electrodes, of which transistors the first electrodes are connected to the first point, is characterized in that the third electrodes of the first and the second transistor are connected to first and second resistors of substantially equal resistance value which are respectively included in the first and the second current circuit, and that the second switching means are constituted by a first alternating switch for connecting the second electrode of the first transistor alternately to that end of the first resistor which is remote from the third electrode of the first transistor and to the third electrode of the second transistor, and a second alternating switch for connecting the second electrode of the second transistor alternately to that end of the second resistor which is remote from the third electrode of the second transistor and to the third electrode of the first transistor, in phase opposition to the first alternating switch.

In the case that bipolar transistors are used in this type of current stabilizing arrangement, the resistor across which the voltage appears which equals the difference between the base-emitter voltage of the two transistors is included at the collector side. In the one switching condition the third circuit is established between that end of the resistor in the first current circuit which is remote from the first transistor via the base-emitter junction of the first transistor to the first point and the fourth circuit, between that end of the resistor in the first current circuit which is remote from the first transistor via said resistor and the base-emitter junction of the second transistor to the first point, and in the other switching condition mutatis mutandis the same with the second and first transistor instead of the first and the second transistor, respectively. In this current stabilizing arrangement the switches are included in the third and the fourth circuit, but because they are included in the base circuits of the two transistors only a small current flows through said switches, so that their internal resistance plays a minor role. The foregoing also applies to field-effect transistors with source, drain and gate electrodes instead of emitter, collector and base electrodes respectively. If insulated-gate field-effect transistors are used, substantially no current flows through the second switching means (only charging and discharging currents for the gate capacitance) and the switches hardly affect the voltages across the third and the fourth circuit.

In the last-mentioned type of current stabilizing arrangement it may be of advantage that said first switching means are constituted by a cross-over switch which is included between the two resistors and the current mirror circuit in said current circuits for periodically interchanging the currents in said current circuits.

Said cross-over switch is included between the current mirror circuit and the two semi-conductor elements, so that neither the voltage across the two circuits nor the ratio of the currents in the two current circuits are influenced by said first switching means.

In the last-mentioned type of current stabilizing arrangement, in which said current mirror circuit comprises a differential amplifier with an inverting and a non-inverting input and at least one output which is non-inverting relative to said inputs, while said first and second current circuits are established via resistors which each time connect an output of said differential amplifier to an input, so that said ratio is determined by the ratio of the resistances between the output and the two inputs, in such a way that the resistance between said output and the input which is inverting relative to said output is higher than the resistance between said output and the input which is non-inverting relative to said output, it is advantageous in respect of the last-mentioned step that said resistances between the inputs and output are constituted by a second, third and fourth resistor, of which the second and the fourth resistor are substantially identical and of which the second and the fourth resistor are each connected to one of the two inputs with one end and each to an other end of the third resistor with the other end, and said switching means each time connecting one of the two ends of the third resistor alternately to an output of the differential amplifier in such a way that the resistance between the output and the input which is inverting relative to said output is always higher than the resistance between said output and the input which is non-inverting relative to said output.

This step enables the number of switches, specifically the number of switching transistors, to be reduced. For reasons of stability the input which is inverting relative to the output should then always be connected to the lowest resistance. An attractive step to achieve this is characterized in that the differential amplifier relative to the non-inverting input has a non-inverting and an inverting output, one end of the second resistor being connected to the inverting input and one end of the fourth resistor being connected to the non-inverting input, while said switching means connect the inverting output to the other end of the second resistor and the non-inverting output to the other end of the fourth resistor via switches which are alternately closed.

BRIEF DESCRIPTION OF THE INVENTION

The invention will now be described in more detail with reference to the drawing, which shows some of embodiments of the invention. In the drawing:

FIG. 1 is a first embodiment of a current stabilizing arrangement in accordance with the invention;

FIG. 2 a second embodiment;

FIG. 3 a third embodiment;

DESCRIPTION OF THE PREFERRED EMBODIMENTS

Figure 1:
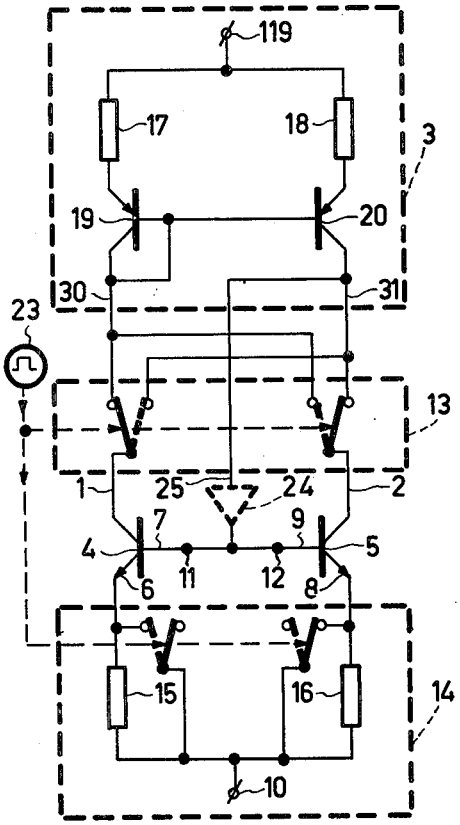

FIG. 1 shows an embodiment of a current stabilizer in accordance with the invention. The arrangement comprises a current mirror circuit 3 with two transistors 19 and 20 which via emitter resistors 17 and 18 respectively are connected to a point 119 at which the currents flowing in the circuit are available. The base electrodes of the two transistors are interconnected and the collector and the base of transistor 19 are interconnected.

If the values of the resistors 17 and 18 have a ratio of 1:n and if the effective base-emitter area of transistor 19 is preferably n-times greater than the effective base-emitter area of transistor 20, the collector currents of the transistors 19 and 20 will have a ratio of n:1. This ratio could also be achieved if the emitters of the transistors 19 and 20 were interconnected and these transistors were integrated on one substrate, but then process variations would render the factor n inaccurate. The values of the resistors 17 and 18 can be very accurate if for example selected non-integrated resistors are used for this purpose.

The arrangement furthermore comprises a first (1) and a second (2) current circuit which can be connected in series with the main current path 30 and 31 of the transistors 19 and 20 respectively via a cross-over switch 13. The cross-over switch 13 is switchable under command of a clock generator 23. In the one switching condition (shown) the current circuits 1 and 2 are connected in series with the main current paths 30 and 31 respectively and in the other switching connection in series with the main current paths 31 and 30 respectively.

The current circuits 1 and 2 include the main current paths of the transistors 4 and 5 respectively, whose emitter electrodes are connected to a first point 10 for current take-off via resistors 15 and 16 respectively. The base electrodes 7 and 9 of the transistors 4 and 5 respectively are connected to points 11 and 12 respectively. Thus, the third and the fourth circuit are formed between points 11 and 10 and between points 12 and 10 respectively. In order to sustain equal voltages across the two circuits the points 11 and 12 are interconnected. These interconnected base electrodes are driven via a circuit 25 from the circuit 31 of the current mirror 3, as the case may be via an amplifier 24. In order to alternately include a resistor in the third or the fourth circuit, the resistors 15 and 16 are shunted by switches which under command of the clock generator 23 are alternately opened and closed in phase opposition to each other. For reasons of stability this phase should be so relative to the switch 13, that always the non-short-circuited resistor is included in the current circuit 1 or 2, whichever circuit is connected to the main current path 30 via the switch 13. The phase relationship shown meets this requirement. Moreover, this current circuit should carry the smaller of the two currents, which implies that the value of resistor 17 should be greater than the value of resistor 18.

If the value of the resistors 15 and 16 equals R, the current in main current path 30 is I, and the current in main current path 31 is nI, n being the ratio of the values of the resistors 17 and 18, the voltage $V_1$ across the third circuit (between point 11 and 10) in the shown switching condition is:

$$V_1=(kT/q)\ \ln\ (I/i_{01})+IR$$

where $i_{01}$ is the reverse saturation current of the transistor 4. The voltage $V_2$ across the fourth circuit (between points 12 and 10) is:

$$V_2=(kT/q)\ \ln\ (I/i_{02})$$

where $i_{02}$ is the reverse saturation current of the transistor 5. Owing to the direct connection between points 11 and 12 the voltages $V_1$ and $V_2$ are equal, so that the current I is:

$$I=(kT/qR)\ \ln\ n\ (i_{01}/i_{02})$$

A similar calculation in the other switching condition (the dashed position of the switches) yields:

$$I=(kT/qR)\ \ln\ n\ (i_{02}/i_{01})$$

In both cases the total current at points 119 and 10 (when base current losses are neglected) equals $(n+1)I$.

For the current I the following applies:

$$I=I_o+I_1P(f)$$

where $I_0$ is the d.c. component of the current I and $I_1P(f)$ is a unit squarewave of a frequency f and with a peak-to-peak amplitude of $2I_1$. For $I_0$ and $I_1$ it is then found that:

$$I_o=\frac{1}{2}\left(\frac{kT}{qR}\ \ln\ n\ \frac{i_{02}}{i_{01}}+\frac{kT}{qR}\ \ln\ n\ \frac{i_{01}}{i_{02}}\right)=\frac{kT}{qR}\ \ln\ n$$

and $$I_1=\frac{kT}{qR}\ \ln\ n\ \frac{i_{01}}{i_{02}}.$$

The a.c. component $I_1P(f)$ can be filtered out in a simple manner, for example by connecting points 10 and/or 119 to a reference potential via a capacitor, so that at these points a current is obtained which equals $(n+1)I_0$.

In this respect it is to be noted that the step in accordance with the invention is only useful if the inequality of the transistors 4 and 5 is the main source of errors. Thus, an accurate current mirror must be used for the current mirror 3, which for example features compensation for base current losses by means of known technologies, or for example by using the current mirror known from U.S. Pat. No. 3,982,172. Moreover it is useful to use an amplifier 24 in order to counteract base current losses. In addition the switches which switch the resistors 15 and 16 must comply with stringent requirements because these form part of the third and the fourth circuit.

Figure 2:
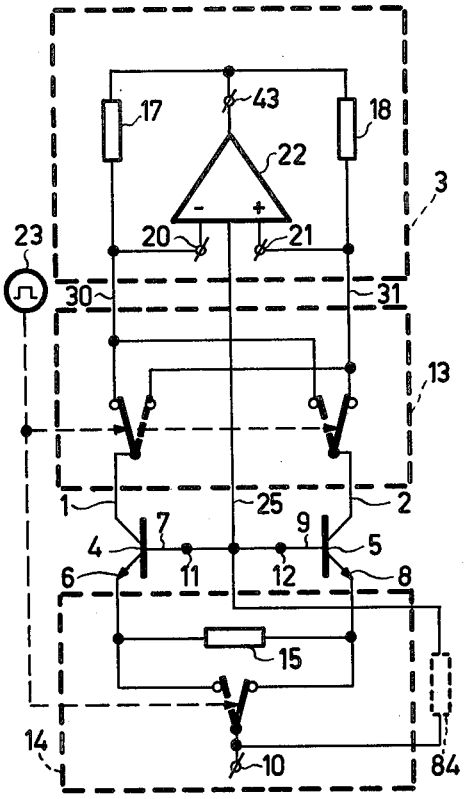

FIG. 2 shows an embodiment of a current stabilizer in which the last-mentioned switches need not comply with stringent requirements. The current stabilizer comprises a different type of current mirror 3 for the purpose of illustration. This current mirror comprises a differential amplifier 22 with an inverting input 20 and a non-inverting input 21 and an output 43. The output 43 is connected to the inputs 20 and 21 via resistors 17 and 18 respectively. These resistors 17 and 18 form main current paths 30 and 31 respectively, in which the currents have the same ratio as the resistances 17 and 18, because the differential amplifier 22 sustains substantially equal voltages across these resistors. From the differential amplifier 22 a drive circuit 25 leads to the base electrodes of the transistors 4 and 5 in a manner known from U.S. Pat. No. 3,914,683.

In a similar way as in the current stabilizer in accordance with FIG. 1 the cross-over switch 13 is included to connect the main current paths 30 and 31 to the current circuits 1 and 2.

The emitter electrodes of the transistors 4 and 5 are interconnected via a resistor 15 and connected to the first point 10 via an alternating switch which is activated by the source 23. As a result of this the resistor 15 is included in the third or the fourth circuit dependent on the position of said alternating switch. The phase relationship between said alternating switch and the cross-over switch 13 is determined by the stability requirement that the inverting input 20 of the differential amplifier 22 should be connected to that of the current circuits 1 and 2 which includes the resistor 15. The switches shown meet this requirement. For the same reason as in the current stabiliser of FIG. 1 the value of the resistor 17 must be greater than the value of the resistor 18. The operation of the stabiliser is the same as that of FIG. 1, with the proviso that said alternating switch is included in the common part of the third and the fourth circuit and thus does not influence the value of the stabilised current I.

For the purpose of illustration a resistor 84 is shown in FIG. 2 by dashed lines, which resistor is included between the common base electrodes of the transistors 4 and 5 and point 10. As previously stated this resistor adds a current with a negative temperature coefficient to the stabilised current which flows through point 10 in order to obtain a temperature-independent overall current.

Figure 3:
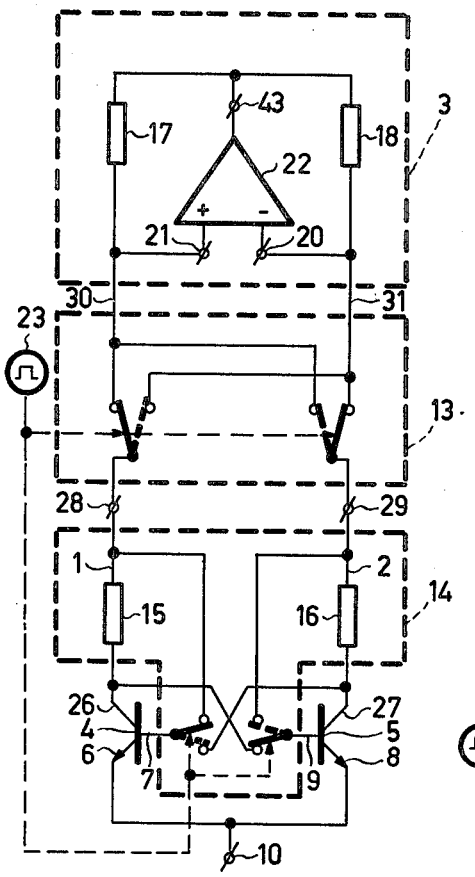

FIG. 3 shows a different path of current stabiliser to which the steps in accordance with the invention have been applied. In a similar way as the current stabiliser of FIG. 2 it comprises a current mirror circuit 3 with a differential amplifier 22 with resistors 17 and 18 between its output 43 and its inputs 21 and 20 respectively. Furthermore, this stabiliser in a similar way of the stabiliser of FIG. 2 comprises a cross-over switch 13 between the current mirror 3 and the first (1) and the second (2) current circuit. The first and the second current circuit comprises the main current paths of the transistors 4 and 5 respectively, whose respective emitters 6 and 8 are connected to the first point 10. In the first and the second current circuit equal resistances 15 and 16 are included between points 28 and 29 respectively and the collector electrode 26 and 27 of the transistors 4 and 5 respectively.

In the shown position of the switching means 14 the point 28 is connected to the base electrode 7 of the transistor 4 and the collector electrode 26 of the transistor 4 to the base electrode 9 of transistor 5. The third circuit is now established between point 28 and point 10 via the base-emitter junction of transistor 4 and the fourth circuit between point 28 and point 10 via the resistor 15 and the base-emitter junction of transistor 5. In the other switching position, shown dotted, point 29 is connected to the base electrode 9 of transistor 5 and the collector electrode of transistors 5 to the base electrode of transistor 4. The third circuit is now formed between point 29 and point 10 via the resistor 16 and the base-emitter junction of transistor 4 and the fourth circuit between point 29 and point 10 via the base-emitter junction of transistor 5.

If the switching means 14 are changed over periodically a resistor is alternately included in the third and the fourth circuit, and, provided that the cross-over switch 13 is also switched in the correct phase, the same effect is obtained as in the circuit arrangements in accordance with FIGS. 1 and 2. For reasons of stability this phase should be such that the non-inverting input 21 of the differential amplifier 22 is always coupled to that circuit of the current circuits 1 and 2 which includes the resistor 15 or 16, whichever is included in the third or the fourth circuit at that instant. The current in this circuit should then also be the larger, which implies that the resistance 18 between the inverting input 20 and the output 43 of the differential amplifier 22 should be higher than the resistance 17.

In this example the second switching means 14 form part of the third and the fourth circuit, but are only traversed by base current and not by the currents in the first and the second current circuit, so that this may present less problems, in particular when the stabiliser employs insulated-gate field-effect transistors.

The switching means shown in FIGS. 1, 2 and 3 may be realised in various manners.

Figure 4:
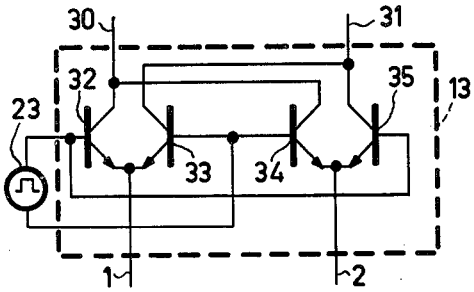
FIG. 4 is an example of the first switching means for the embodiment of FIG. 1.

FIG. 4 shows an example of the cross-over switch 13. This switch comprises the transistors 32, 33, 34 and 35. The emitters of the transistors 32 and 33 lead to the first current circuit 1 and those of the transistors 34 and 35 to the second current circuit 2. The collectors of the transistors 32 and 34 lead to the main current path 30 and the collectors of the transistors 33 and 35 to the main current path 31. The base electrodes of the transistors 33 and 34 as well as the base electrodes of the transistors 32 and 35 are interconnected. Between the two pairs of base electrodes a switching voltage is applied with the aid of the source 23, by means of which either the transistors 32 and 35 or the transistors 33 and 34 are turned on, so that the main current path 30 or 31 is either connected in series with the current circuit 1 and 2 respectively or in series with the current circuit 2 and 1 respectively.

Figure 5:
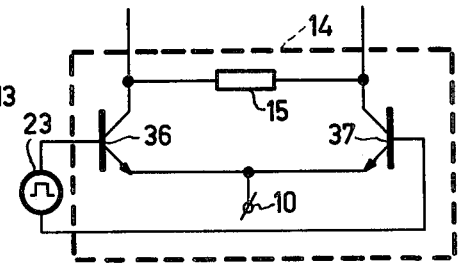
FIG. 5 is an example of the second switching means for the embodiment of FIG. 2.

FIG. 5 shows an example of the switching means 14 of the stabiliser of FIG. 2. The resistor 15 is included between the collectors of the transistors 36 and 37 whose emitter lead to the point 10. Between the base electrodes a switching voltage is applied with the aid of the source 23, so that either transistor 36 or transistor 37 is turned on and as a consequence either the one or the other end of the resistor 15 is conductively connected to the first point 10. The conductive transistor is then preferably bottomed, for example by driving it from a base-current source which can be switched off.

Figure 6:
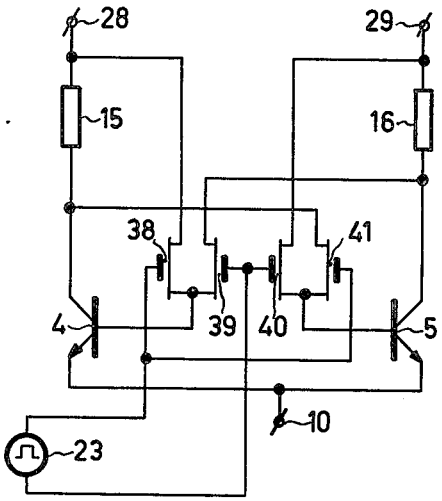
FIG. 6 is an example of the second switching means for the embodiment of FIG. 3.

FIG. 6 shows an example of the switching means 14 of the stabiliser of FIG. 3. The switching means comprise transistors 38, 39, 40, and 41. The source electrodes of the transistors 38 and 39 lead to the base electrode of the transistor 4 and those of the transistors 40 and 41 to the base electrode of the transistor 5. The drain electrodes of the transistors 38, 39, 40 and 41 respectively lead to point 28, the collector electrode of transistor 5, point 29, and the collector electrode of the transistor 4. Between the interconnected control electrodes of the transistors 38 and 41 and the interconnected control electrodes of the transistors 39 and 40 a switching voltage is applied with the aid of a source 23, so that either the transistors 38 and 41 or the transistors 39 and 40 are turned on. In this way the desired switching pattern is obtained.

Instead of the present current mirror circuit 3 numerous other current mirror circuits are possible. It is alternatively possible to combine the current mirror circuit with the first switching means 13 so as to form a switched current mirror.

Figure 7:
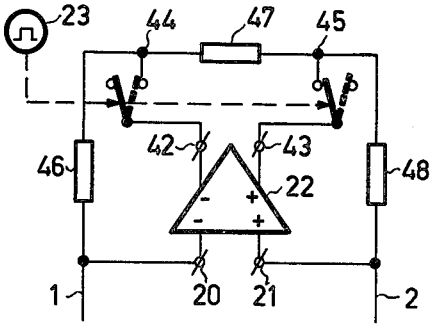
FIG. 7 is a first example of a combination of the current mirror circuit and the first switching means.

FIG. 7 shows an example of such a switched current mirror. The differential amplifier 22 has an inverting input 20 and a non-inverting input 21 and an output 42 which is inverting relative to the non-inverting input 21 and an output 43 which is non-inverting relative to the non-inverting input 21. Between the input 20 and a point 44 a resistor 46 is included, between input 21 and point 45 a resistor 48 and between points 44 and 45 a resistor 47. Via two switches points 44 and 45 can alternatively be connected to the outputs 42 and 43 respectively under command of the source 23.

If the ratio of the resistances 46, 47 and 48 is 1:n-1:1, the resistance values between output 43 and the inputs 20 and 21 respectively in the switching condition shown have a ratio of n:1 and the resistance values between the inputs 20 and 21 and the output 42 in the other switching position have a ratio of 1:n. Thus, the ratio of the current flowing in the first (1) and the second (2) current circuit can be reversed with the aid of the switches, or in other words the currents in the two current circuits can be interchanged. By using both outputs of the differential amplifier 22 instead of one of them the stability requirement is always met automatically. In the case of the arrangement of FIG. 3, the inputs 20 and 21 must be connected to the current circuits 1 and 2 in exactly the opposite manner.

Figure 8:
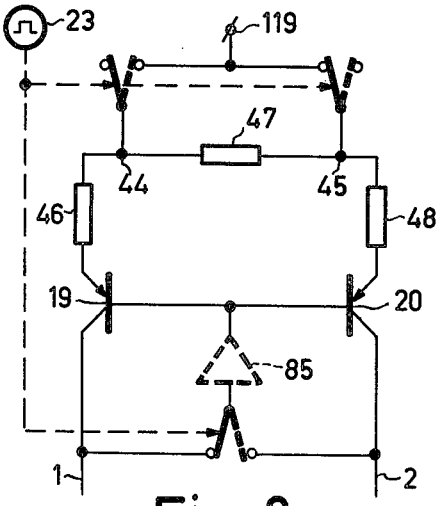
FIG. 8 is a second example of a combination of the current mirror circuit and the first switching means.

FIG. 8 shows a second example of a switched current mirror. It comprises two transistors 19 and 20 with common-base electrodes. The emitters of the transistors 19 and 20 are connected to points 44 and 45 respectively via resistors 46 and 48 respectively. Between points 44 and 45 a resistor 47 is included. Via switches which are activated by the source 23 points 44 and 45 can alternately be connected to a current output point 119.

If the values of the resistors 46, 47 and 48 have a ratio of 1:n-1:1 the ratio of the total emitter resistances of the transistors 19 and 20 in the switching position shown is n:1 and, provided that said resistances are sufficiently high to allow base-emitter voltage differences of the transistors 19 and 20 to be neglected, the ratio of the collector currents of the transistors 19 and 20 is 1:n. In the other switching position under the same conditions the ratio of the collector currents of the transistors 19 and 20 will be n:1. In order to enable said stability requirements to be met, the base electrodes of transistors 19 and 20 should alternately be driven from the collector electrode of transistor 19 or 20 under command of source 23. This can be achieved by including an alternating switch between said collector electrodes and the common base electrodes. In order to reduce base current influences it is desirable to include an amplifier 85 in the drive circuit. In the situation shown the switched current mirror of FIG. 8 meets the stability requirement of the current stabilizing arrangement in accordance with FIGS. 1 and 2. In the case of the current stabilizing arrangement of FIG. 3, the collectors of transistors 19 and 20 should be connected to the current circuits 1 and 2 exactly the other way around.

Figure 9:
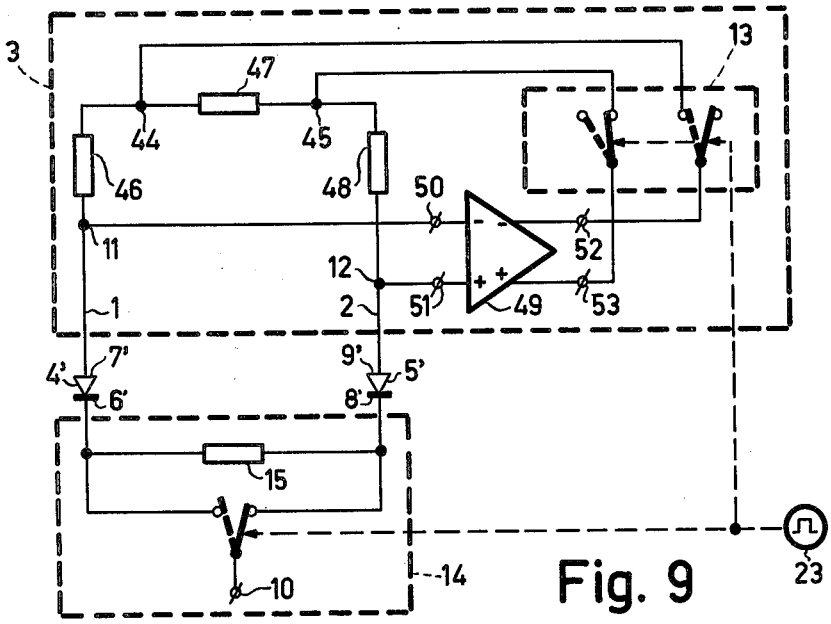
FIG. 9 is a fourth embodiment of a current stabilizing arrangement in accordance with the invention in which the two semiconductor elements are diodes.

FIG. 9 shows a current stabilizer in which the two semiconductor elements are constituted by diodes (or transistors connected as diodes). The diodes 4' and 5' are included in the forward direction in the first (1) and the second (2) current circuit between point 11 and the third point 12 respectively and the first point 10. Between the first electrode 6' and 8' of the two diodes the resistor 15 is included. The two ends of said resistor 15 can alternately be connected to the first point 10 under command of the source 23, so that the resistor 15 is alternately included in the third (11-10) or fourth (12-10) circuit. Points 11 and 12 are respectively connected to the inverting (50) and non-inverting (51) input of a differential amplifier 49 whose outputs are connected to the inputs via resistors. If the gain factor of the differential amplifier is sufficiently high, equal voltages are maintained at points 11 and 12.

Relative to the non-inverting input 51 the differential amplifier 49 has an inverting output 52 and a non-inverting output 53. These outputs and the inputs, in a similar way as in the case of the switched current mirror in accordance with FIG. 7, are coupled by resistors 46, 47 and 48 so that the differential amplifier 47, which maintains equal voltages across the third and the fourth circuit, also forms part of the switched current mirror. With respect to the stabilization of the currents this stabilizer arrangement operates in the sameway as the stabilizer of FIG. 2.

In the current stabilizers of FIGS. 1, 2, 3 and 9 the ratio of the currents in the two current circuits 1 and 2 was completely determined by the current mirror circuit 3. However, it is alternatively possible to define the ratio of these currents by selecting a current mirror circuit with a current ratio of 1:1 and by connecting a number of semiconductor elements parallel to either the first or the second semiconductor element, or by a combination of the two methods.

Figure 10:
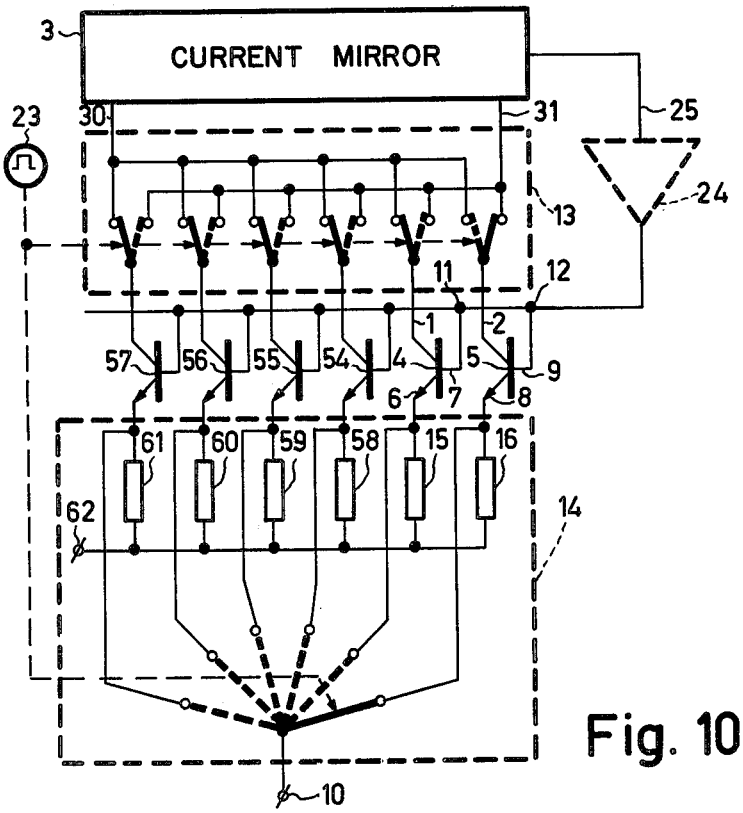
FIG. 10 is a fifth embodiment with a multiplicity of parallel semiconductor elements.

FIG. 10 shows such a current stabilizer, which employs the steps in accordance with the invention. The circuit arrangement of FIG. 10 again comprises a first (1) and a second (2) current circuit in which the main current paths of the transistors 4 and 5 are included respectively. The emitter electrodes 6 and 8 of these transistors are connected to a point 62 via resistors 15 and 16 respectively. The emitter electrodes can be connected to the first point 10 via switches. Apart from the further transistors, it is thus possible in a similar way as in the circuit of FIG. 2, to include a resistor (15 or 16) in the third or the fourth circuit between points 11 or 12 and 10 respectively. For maintaining equal voltages across the third and the fourth circuit points 11 and 12, i.e. the base electrodes of the transistors 4 and 5, are interconnected. These interconnected base electrodes are connected to the base electrodes of transistors 54, 55, 56, 57 (i.e. four additional transistors in the present example), whose emitters are connected to point 62 via resistors 58, 59, 60 and 61. The resistors 15, 16, 58, 59, 60 and 61 all have equal values R. The switching means 14 can connect one of the emitters of the transistors 4, 5, 54, 55, 56, 57 to the first point 10 in a cyclicly permuting fashion under command of the source 23. Under command of the source 23 the switching means 13 connect the collector of that transistor whose emitter is connected directly to the first point 10 to the main current path 31 and the collectors of the other transistors jointly to the main current path 30.

If a current $I_O$ flows in the main current path 30 and a current $mI_O$ in the main current path 31 and if the number of transistors is n+1, a current $mI_O$ flows through that transistor whose emitter is connected directly to the first point 10 and the current $I_O$ in the main current path 30 is substantially uniformly divided among the n main current paths of the other transistors, so that parallel to the base-emitter junction of the transistor through which the current $I_O$ flows another circuit is formed comprising the base-emitter junction of the transistor through which a current $nI_O$ flows in series with a resistor. Thus, in each switching position the circuit operates as a current stabilizer with two current circuits in which currents with a ratio of 1:mn flow and in which the value of the resistance in the circuit through which the smaller current flows equal (m+1) R. The errors owing to mutual inequalities of the transistors are again averaged out by cyclically permuted switching.

Figure 11:
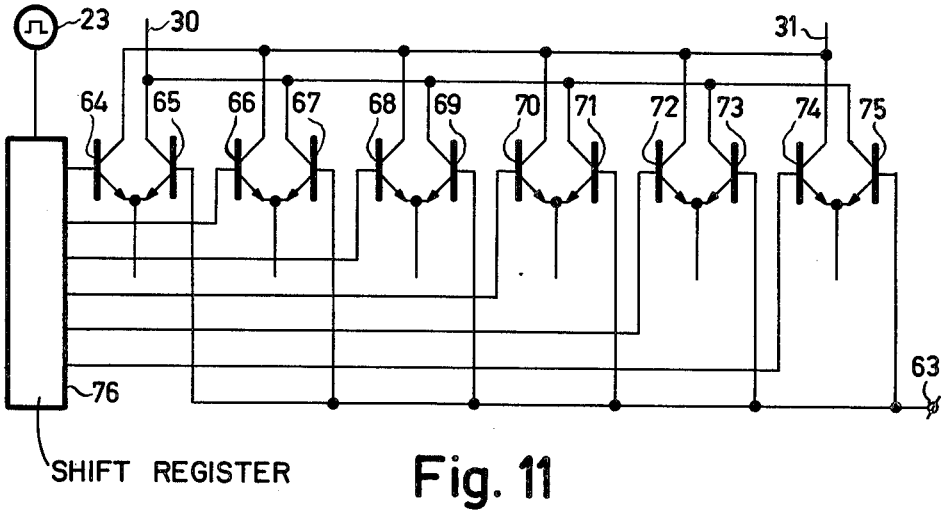
FIG. 11 is an example of the first switching means for the circuit arrangement in accordance with FIG. 10.

FIG. 11 shows an example of the switching means 13. These switching means comprise n+1 transistor pairs (64, 65), (66, 67), (68, 69), (70, 71), (72, 73) and (74, 75). The emitters of each pair are interconnected and are each time connected to the collector of one of the n+1 transistors 57, 56, 55, 54, 4, 5. The collector of the transistors 65, 67, 69, 71, 73 and 75 lead to the main current path 30 and the collectors of the other transistors to main current path 31.

The base electrodes of the set of transistors, for example the transistors 65, 67, 69, 71, 73 and 75, are connected to a point 63 at reference potential and the other base electrodes lead to a circuit 76, for example a shift register, which under command of the source 23 applies a high voltage to the base electrode of one of the transistors 64, 66, 68, 70, 72 and 74 and a low voltage to the remaining n of said transistors in a cyclically permuting fashion, so that the main current path 31 leads to one conductive switching transistor and the main current path 30 to the remaining n conducting transistors.

Figure 12:
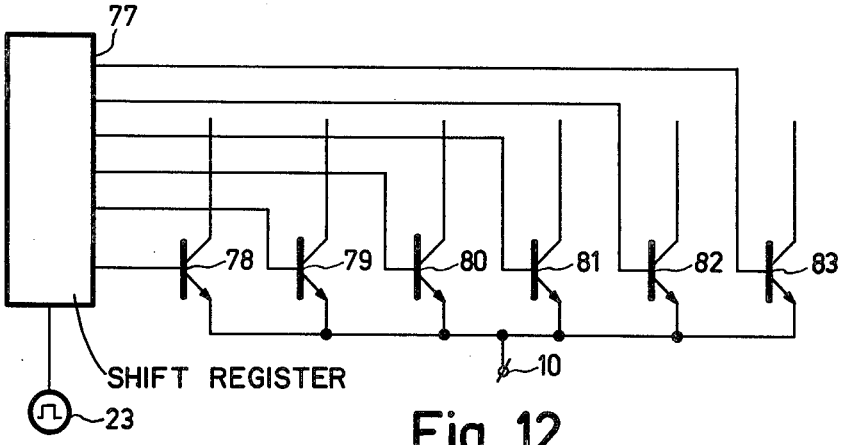
FIG. 12 is an example of the second switching means for the circuit arrangement in accordance with FIG. 10.

FIG. 12 shows an example of the switching means 14. These means comprise n+1 transistors 78 through 83, whose emitters are connected to the first point 10, whose collectors are individually connected to the emitter electrodes of the transistors 57, 56, 55, 54, 4 and 5 respectively. The base electrodes of said transistors 78 through 83 lead to a circuit 77, for example a shift register, which under command of the source 23 in a cyclically permuting fashion applies a high voltage to the base electrode of one of the transistors 78 through 83 and a low voltage to the other transistors, so that always one of the n+1 transistors 57, 56, 55, 54, 4 and 5 is connected directly to point 10 with its emitter electrode. The transistors 78 through 83 may also be turned on by applying a base current to the transistor to be turned on. The circuits 76 and 77 may then form one circuit.

The use of shift registers renders it possible not to connect the collector of some of the n+1 transistors 5, 4, 54, 55, 56 and 57 to the main current path 30, so as to enable the factor n to be changed. It is then also possible to connect the emitters of a plurality of transistors directly to a point 10 in a cyclically permuting fashion.

What is claimed is:

1. A current stabilizing arrangement comprising:

a first and a second current circuit;

a current mirror circuit for sustaining unequal currents with a fixed ratio relative to each other in said current circuits;

a first semiconductor element with a main current path and at least a first and a second electrode, of which at least the first electrode is situated in said main current path, the current in said main current path being a defined function of the voltage between said electrodes;

the main current path of said first semiconductor element being included in the forward direction in said first current circuit between said current mirror circuit and a first point;

a second semiconductor element substantially identical to said first semiconductor element and whose main current path is included in the forward direction in said second current circuit between said current mirror circuit and said first point;

both of said semiconductor elements being formed on one substrate;

a third circuit between a second point and said first point connected through said second and said first electrodes of said first semiconductor element;

a fourth circuit between a third point and said first point through the second and the first electrode of the second semiconductor element; and means for sustaining equal voltages across said third and the fourth circuits, wherein said current stabilizing arrangement furthermore comprises:

first switching means for periodically interchanging the currents in said current circuits; and second switching means including a resistor of substantially the same resistance value in said third and the fourth circuits, which circuit includes the two electrodes of that semiconductor element in which the smaller of the two currents flows, in such a way that the same one of said two currents flows through said resistor in said third and fourth circuit.

2. A current stabilizing arrangement as claimed in claim 1, in which said means for sustaining equal voltages are constituted by a connection of said second to said third point, which second and third points are constituted by the second electrodes of said two semiconductor elements and in which this connection is driven by said current mirror circuit, wherein said first switching means comprises:

a cross-over switch included between said two semiconductor elements and said current mirror circuit in said current circuits for periodically interchanging the currents in said current circuits; and a drive circuit by-passing said cross-over switch.

3. A current stabilizing arrangement as claimed in claim 1, in which:

the second and the third point are constituted by the second electrodes of said first and said second semiconductor elements respectively;

said current mirror circuit comprises:

a differential amplifier with an inverting and non-inverting input and at least one output which is non-inverting relative to said inputs;

said first and second current circuits being connected through via resistors which connect an output of said differential amplifier to an input, so that a ratio is determined by the ratio of the resistances between the output and the two inputs, in such a way that the resistance between said output and the input which is inverting relative to said output is higher than the resistance between said output and the input which is non-inverting relative to said output, wherein:

said resistances between the inputs and the output are constituted by a second, third and fourth resistors, of which the second and fourth resistor are substantially identical and of which the second and the fourth resistor are each connected with one end to one of said two inputs and with the other end each to an other end of said third resistor; and said first switching means alternately connecting one of the two ends of said third resistor to an output of said differential amplifier, in such a way that the resistance between said output and the input which is inverting relative to said output is always higher than the resistance between said output and the input which is non-inverting relative to said output.

4. A current stabilizing arrangement as claimed in claim 3, wherein:

said differential amplifier comprises a non-inverting and an inverting output relative to the non-inverting input;

a second resistor being connected with one end to the inverting input;

the fourth resistor being connected with one end to the non-inverting input; and said switching means, connected through switches, connecting the inverting output to the other end of the second resistor and the non-inverting output to the other end of the fourth resistor, which switches are alternately closed.

5. A current stabilizing arrangement as claimed in claim 1, further comprising:

said first and second semiconductor elements are first and second transistors whose control electrodes constitute said second electrodes;

said control electrodes being interconnected for sustaining equal voltages across third and the fourth circuits and being driven by said current mirror circuit, parallel to that transistor whose main current path is included in said current circuit for conducting the smaller current n−1, being greater than one;

further n+1 transistors being included substantially identical to said first and the second transistors and whose control electrodes are connected to the control electrodes of said first and second transistors wherein:

said first electrodes of said n+1 transistors lead to a common point through resistors of substantially equal resistance value;

said second switching means are constituted by an (n+1) step switch for connecting a first point in a cyclically permuting fashion to the first electrodes of at least one of the said n+1 transistors; and the second transistor and to the third electrode of the first transistor in phase opposition to the first switch.

6. A current stabilizing arrangement as claimed in claim 1, in which:

said first and said second semiconductor elements are first and second transistors, whose control electrodes constitute the second electrodes and whose main current paths at the sides of the third electrodes which are remote from the first electrodes are provided with third electrodes of which transistors the first electrodes are connected to the first point wherein:

the third electrodes of the first and second transistors are respectively connected to first and second resistors of substantially equal resistance value which are included in said first and the second current circuits respectively;

said second switching means are constituted by a first alternating switch for alternately connecting the second electrode of the first transistor to that end of the first resistor which is remote from the third electrode of the first transistor and to the third electrode of the first transistor and to the third electrode of the second transistor; and a second alternating switch for connecting the second electrode of the second transistors alternately to that end of the second resistor which is remote from the third electrode of the second transistor and to the third electrode of the first transistor in phase opposition to the first alternating switch.

7. A current stabilizing arrangement as claimed in claim 6, wherein:

said first switching means are constituted by a cross-over switch which is included between the two resistors and the current mirror circuit in said current circuits for periodically interchanging the current in said current circuits.

8. A current curring stabilizer as claimed in claim 6, wherein said current mirror circuit comprises:

a differential amplifier with an inverting and a non-inverting input and at least one output which is non-inverting relative to said inputs;

said first and second current circuits are connected through resistors each of which connects an output of said differential amplifier to an input, so that a ratio is determined by the ratio of the resistances between the output and the two inputs, in such a way that the resistance between said output and the input which is inverting relative to said output is higher than the resistance between said output and the input which is non-inverting relative to said output, wherein: said resistances between inputs and output are constituted by second, third and fourth resistors, of which the second and the fourth resistors are substantially identical and of which the second and the fourth resistors are each connected to one of the two inputs with one end and each to an other end of the third resistor with the other end, and said switching means alternately connecting one of the two ends of the third resistor to an output of said differential amplifier in such a way that the resistance between the output and the input which is inverting relative to said output is always higher than the resistance between said output and the input which is non-inverting relative to said output.

9. A current stabilizer as claimed in claim 8, wherein said differential amplifier comprises:

a non-inverting and an inverting output relative to the non-inverting input;

one end of the second resistor being connected to the inverting input and one end of the fourth resistor to the non-inverting input; and said switching means connecting the inverting output to the other end of the second resistor and the non-inverting output to the other end of the fourth resistor through switches which are alternately closed.

10. A current stabilizing arrangement comprising:

a first and a second current circuit;

a current mirror circuit for sustaining unequal currents with a fixed ratio relative to each other in said current circuits;

a first semiconductor element with a main current path and at least a first and a second electrode, of which at least the first electrode is situated in said main current path, the current in said main current path being a defined function of the voltage between said electrodes;

the main current path of said first semiconductor element being included in the forward direction in said first current circuit between said current mirror circuit and a first point;

a second semiconductor element substantially identical to said first semiconductor element and whose main current path is included in the forward direction in said second current between said current mirror circuit and said first point;

both of said semiconductor elements being formed on one substrate;

a third circuit between a second point and said first point connected through said second and said first electrodes of said first semiconductor element;

a fourth circuit between a third point and said first point through the second and the first electrode of the second semiconductor element; and means for sustaining equal voltages across said third and the fourth circuits, wherein said current stabilizing arrangement furthermore comprises:

first switching means for periodically interchanging the currents in said current circuits; and second switching means comprising:

a first resistor which is included between the first electrodes of the two semiconductor elements; and a switch for connecting the first point alternately to the one and to the other end of said first resistor in synchronism with the first switching means.

11. A current stabilizing arrangement as claimed in claim 10, in which said means for sustaining equal voltages comprise:

a connection of the second to the third point, which second and third points are constituted by the second electrodes of the two semiconductor elements and in which this connection is driven by said current mirror circuit wherein:

said first switching means are constituted by a cross-over switch is included between the two semiconductor elements said current mirror circuit in said current circuits for periodically interchanging the currents in said current circuits, and a drive means by-passing said cross-over switch.

12. A current stabilizing arrangement as claimed in claim 10, in which the second and the third point are constituted by the second electrodes of the first and the second semiconductor element respectively and said current mirror circuit comprises:

a differential amplifier with an inverting and non-inverting input and at least one output which is non-inverting relative to said inputs;

said first and second current circuits being connected through resistors which connect an output of said differential amplifier to an input, so that a ratio is determined by the ratio of the resistances between the output and the two inputs, in such a way that the resistance between said output and the input which is inverting relative to said output is higher than the resistance between said output and the input which is non-inverting relative to said output, wherein:

said resistances between the inputs and the output are constituted by second, third and fourth resistors, of which the second and fourth resistors are substantially identical and of which the second and the fourth resistors are each connected with one end to one of the two inputs and with the other end each to an other end of the third resistor, and said first switching means alternately connecting one of the two ends of the third resistor to an output of said differential amplifier, in such a way that the resistance between said output and the input which is inverting relative to said output is always higher than the resistance between said output and the input which is non-inverting relative to said output.

* * * * *